United States Patent [19]

Laing

[11] Patent Number: 4,615,662

[45] Date of Patent: Oct. 7, 1986

[54] AXIAL THRUST COMPENSATION FOR CENTRIFUGAL PUMP

[76] Inventor: Karsten Laing, 3970 Honeycutt St., San Diego, Calif. 92109

[21] Appl. No.: 800,548

[22] Filed: Nov. 21, 1985

[51] Int. Cl.[4] ..... F04B 17/00

[52] U.S. Cl. ..... 417/420

[58] Field of Search ..... 417/420, 365, 424

[56] References Cited

U.S. PATENT DOCUMENTS

| | | | |
|---|---|---|---|
| 3,135,211 | 6/1964 | Pezzillo | 417/365 X |
| 3,649,137 | 3/1972 | Laing | 417/420 |
| 3,838,947 | 10/1974 | Laing | 417/420 X |
| 4,035,108 | 7/1977 | Laing | 417/365 |

FOREIGN PATENT DOCUMENTS

| | | | |
|---|---|---|---|
| 1538894 | 3/1970 | Fed. Rep. of Germany | 417/420 |
| 2135529 | 1/1980 | Fed. Rep. of Germany | 417/420 |

*Primary Examiner*—Richard E. Gluck

[57] ABSTRACT

A pump motor unit of the type having an impeller connected to the armature, which unit is located in a pump housing whereby the armature is separated from the stator or a driving annular magnet by a magnetic gap in which a magnetically permeable dividing wall is situated, separating the wet side of the pump from the dry side, the dry side containing the electric stator or motor, said impeller armature unit includes radially extending channels whose suction sides communicate with the magnetic gap.

2 Claims, 2 Drawing Figures

AXIAL THRUST COMPENSATION FOR CENTRIFUGAL PUMP

BACKGROUND OF THE INVENTION

This invention relates to centrifugal pumps of the kind having a shrouded impeller and a single entry eye, the impeller being rotatable in a casing the interior of which is subjected to the pressure generated by the pump. In such a pump, the impeller is subjected to an axial thrust because of the following: The effective axially-projected front area of the intake eye is unbalanced with respect to the fluid pressure upon it, namely the mean intake pressure (or "suction"), which acts on the upstream or front side of the impeller only. The fluid pressure within the casing acts on the axially projected area of the shroud to result in an axial thrust on the front of the impeller; in the opposite direction, this fluid pressure acts on the back of the impeller over the whole of its projected area. Such pumps are known (and are the particular kind to which the invention applies) in which the impeller rotor unit embodies an armature having a spherically convex surface corresponding to the spherically concave surface of a thin non-magnetic wall of the casing, there being a small gap between such surfaces. The rotor unit is driven as an induction motor by the electromagnetic field of coil windings external to the said wall. For example, centrifugal pumps of this type are described in U.S. Pat. No. 3,354,833. The magnetic forces tend to thrust the rotor unit axially rearward, but such thrust is not always sufficient to exceed the net axial thrust due to the fluid pressure referred to above.

When the impeller of such a pump is pivotably supported by an axial bearing, the combined effect of the fluid pressure and magnetic thrusts may be such—especially when running in a throttled condition—as to lift the impeller rotor unit away from such bearing. This is a condition that could destroy the pump.

The main aim of the invention is to ensure, in such a pump, that under all conditions of operation, the impeller rotor is held in engagement with the bearing.

SUMMARY OF THE INVENTION

The invention finds application in centrifugal pumps having:

a single-sided shrouded impeller, a casing in which the pump-generated fluid pressure is greater than that in the intake eye a bearing centering the impeller rotor unit and forming an axial bearing to counterbalance the axial magnetic forces in the direction towards the dry side of the pump.

To ensure in such a pump that the impeller rotor is held in engagement with its bearing, the impeller rotor unit includes radially extending channels, arranged in its reverse side plate adjacent to the rotor. Each channel communicates on the inside with the magnetic gap, and on the outside with the fluid on the pressure-side of the pump housing.

The invention can be applied to various embodiments of the foregoing characterising features; two typical designs are illustrated in the accompanying drawings.

DETAILED DESCRIPTION OF THE PREFERRED EMBODIMENTS

Figure 1:
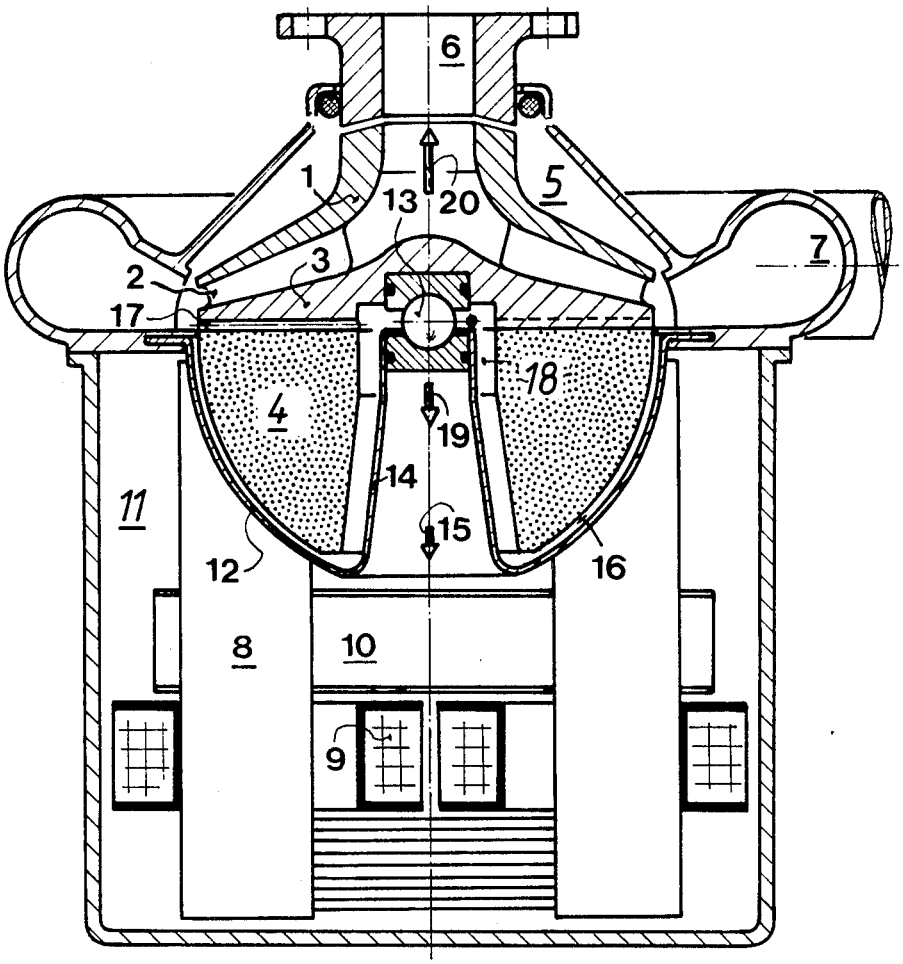
FIG. 1 is a schematic sectional view in the plane of the axis of rotation and of a diameter of the impeller of a centrifugal pump with a spherical magnetic gap.

FIG. 1 shows the pump motor unit whereby the rotatable unit, consisting of the shrouded impeller (1) with the blades (2), the reverse side plate (3), and the spherical rotor (4), is mounted in the wet-side compartment (5) of the pump. The pump housing has a suction-side opening (6) and a pressure-side duct (7). The dry-side compartment (11) contains the stator with the poles (8), the windings (9), and the magnetic yoke (10). The compartment (5) is separated from compartment (11) by the magnetically permeable wall (12). Said wall forms a unit with the rod (14) carrying the ball (13), which support the forces showed by arrow (15) of the rotating unit (1, 2, 3, 4). The spherical rotor (4) forms a narrow gap (16) with the separating wall (12). In the reverse side plate (3), channels (17) connect the space (18), and consequently the narrow gap (16), with the pressure side of the wet compartment (5). The channels (17) generate suction in space (18) and the narrow gap (16). This suction generates an additional thrust symbolised by arrow (19). By number and cross section of said channels (17), this thrust can be arbitrarily chosen. According to the invention this thrust must be larger than the hydraulic thrust, symbolised by arrow (20), caused by the pressure difference between wet compartment (5) and suction-side opening (6).

Figure 2:
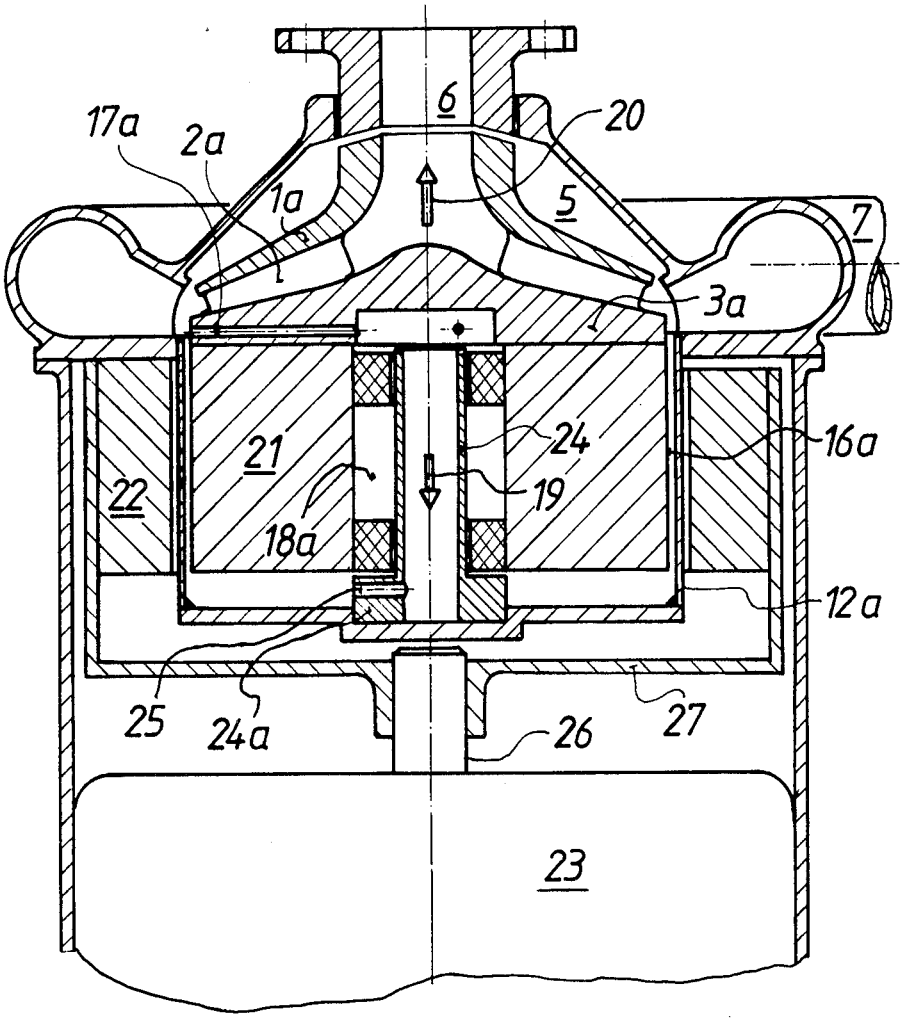
FIG. 2 is the view of a different pump with a cylindrical magnetic gap and a hollow axle constructed according to the invention.

FIG. 2 shows a different design using the same principle for magnetically coupled pumps. The shrouded impeller (1*a*) with the reverse side plate (3*a*) forms a unit with the annular magnet (21) made from permanent magnetic material like barium ferrite. This annular magnet (21) is driven by a second annular magnet (22) mounted on the shaft (26) of motor (23). The hollow axle (24) is mounted in endplate (27) of the magnetically permeable separation wall (12*a*). The gap (16*a*) communicates through the aperture (25) and the hollow axle (24) with the channels (17*a*) in the reverse-side plate (3*a*) of the impeller.

I claim:

1. A centrifugal pump of the type having a casing, an axial fluid inlet (6) in said casing, a rotatable impeller (1, 2, 3) in said casing having an inlet area on its front surface opposite said fluid inlet (6) of the casing, said rotatable impeller (1, 2, 3) subjected to the fluid pressure in said fluid inlet (6) of the casing and possessing a shrouded area on the front surface extending radially outward from said inlet area subjected to increased fluid pressure imparted by said impeller (1, 2, 3) when said pump is operating, said rotatable impeller (1, 2, 3) forming a unit with an annular rotor (4, 21) driven by magnetic forces, the impeller rotor unit (1, 2, 3, 4, 21) being centered in the bore (18) of the rotor (4, 21) and supported in the axial direction to counterbalance axial magnetic forces by bearing means (13, 24) by which said impeller is mounted for rotation and which are located adjacent to the rear plate (3) that divides the impeller (1, 2, 3) from the rotor (4, 21), magnetic means for effecting a magnetic couple with an inductive drive means (4, 21), which is separated by a magnetically permeable separating wall (12) which forms a narrow gap (16) with the rotor (4, 21); the improvement comprises channels (17) arranged in said rear plate (3) and communicating on the periphery of the impeller (1, 2, 3) with the pressure side compartment (5) of the pump and on the inner side with the gap (16).

2. A centrifugal pump according to claim 1 with an impeller (1, 2, 3) forming a unit with an annular magnet (21) having bushings rotatably mounted on an axle (24), said axle consisting of an open ended tube connecting said channels (17*a*) with the narrow gap (16*a*) through its open end and through an aperture (25) near the base (24*a*) of said axle (24).

* * * * *